US010294607B2

(12) United States Patent
Lee et al.

(10) Patent No.: US 10,294,607 B2
(45) Date of Patent: May 21, 2019

(54) DRY CLEANING METHOD AND SYSTEM

(71) Applicants: Jay Sean Lee, Moody, AL (US); Deok Yun Lee, Moody, AL (US); Deok Myung Lee, Moody, AL (US)

(72) Inventors: Jay Sean Lee, Moody, AL (US); Deok Yun Lee, Moody, AL (US); Deok Myung Lee, Moody, AL (US)

(73) Assignees: Jae Sean Lee, Moody, AL (US); Deok Yun Lee, Moody, AL (US); Deok Myung Lee, Moody, AL (US)

( * ) Notice: Subject to any disclaimer, the term of this patent is extended or adjusted under 35 U.S.C. 154(b) by 145 days.

(21) Appl. No.: 14/178,183

(22) Filed: Feb. 11, 2014

(65) Prior Publication Data

US 2014/0259451 A1 Sep. 18, 2014

Related U.S. Application Data

(60) Provisional application No. 61/763,315, filed on Feb. 11, 2013.

(51) Int. Cl.

| | |
|---|---|
| ***D06L 1/12*** | (2006.01) |
| ***D06F 35/00*** | (2006.01) |
| ***D06F 43/00*** | (2006.01) |
| ***D06F 43/02*** | (2006.01) |

(52) U.S. Cl.

CPC ..... *D06L 1/12* (2013.01); *D06F 35/006* (2013.01); *D06F 43/007* (2013.01); *D06F 43/02* (2013.01)

(58) Field of Classification Search

CPC ..... D06B 1/00; F26B 11/02; D06F 43/02
USPC ..... 8/158
See application file for complete search history.

(56) References Cited

U.S. PATENT DOCUMENTS

| | | | | |
|---|---|---|---|---|
| 5,222,267 | A * | 6/1993 | Fierro | 8/158 |
| 7,600,402 | B2 * | 10/2009 | Shin | D06F 25/00 68/5 C |
| 8,100,987 | B2 * | 1/2012 | Middleton | D06F 35/00 134/40 |
| 2004/0010937 | A1 * | 1/2004 | Naganawa et al. | 34/595 |
| 2004/0117920 | A1 * | 6/2004 | Fyvie | D06F 43/086 8/158 |
| 2005/0217035 | A1 * | 10/2005 | Steiner | D06F 39/02 8/149.3 |
| 2008/0041118 | A1 * | 2/2008 | Wong | D06F 39/008 68/5 R |

* cited by examiner

*Primary Examiner* — Gregory R Delcotto
*Assistant Examiner* — Preeti Kumar
(74) *Attorney, Agent, or Firm* — Mintz Levin Cohn Ferris Glovsky and Popeo, P.C.; Kongsik Kim; Derek E. Constantine

(57) ABSTRACT

The present invention relates to dry cleaning system and method thereof. According to the present invention, the dry cleaning system and method provide more economical, safe, convenient, and/or eco-friendly washing.

6 Claims, 4 Drawing Sheets

1: radiator
2: fan motor
3: fan
4: dust removing filter
5: drain bucket
6: water tank
7: hot air/cold air circulation valve
8: water supply
9: water/steam supply
10: steam supply 1: radiator
2: fan motor
3: fan
4: dust removing filter
5: drain bucket
6: water tank
7: hot air/cold air circulation valve
8: water supply
9: water/steam supply
10: steam supply

FIG. 1B

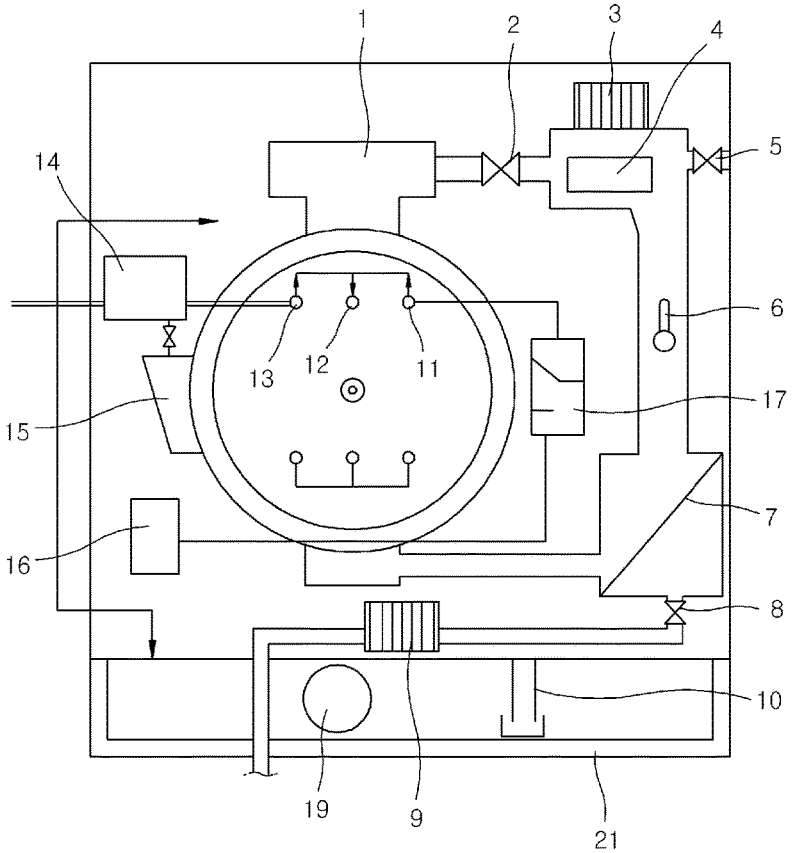

1: radiator
2: hot air/cold air circulation valve
3: fan motor
4: fan
5: air discharge/humidity control valve
6: temperature sensor
7: dust removing filter
8: water drain valve
9: drain pump
10: area of water to be supplied (water amount control sensor by electrical contact)
11: steam supply
12: water/steam supply
13: water supply
14: water meter
15: air pressure control valve
16: steam supplying device
17: detergent supply box
18: air supply valve
19: water tank
20: drum cleaning valve
21: drain bucket 1: radiator
2 fan motor
3: fan
4: dust removing valve
5: drain bucket
6: hot air/cold air circulation valve
7: mist supplying nozzle
8: second dust removing filter

FIG. 2B

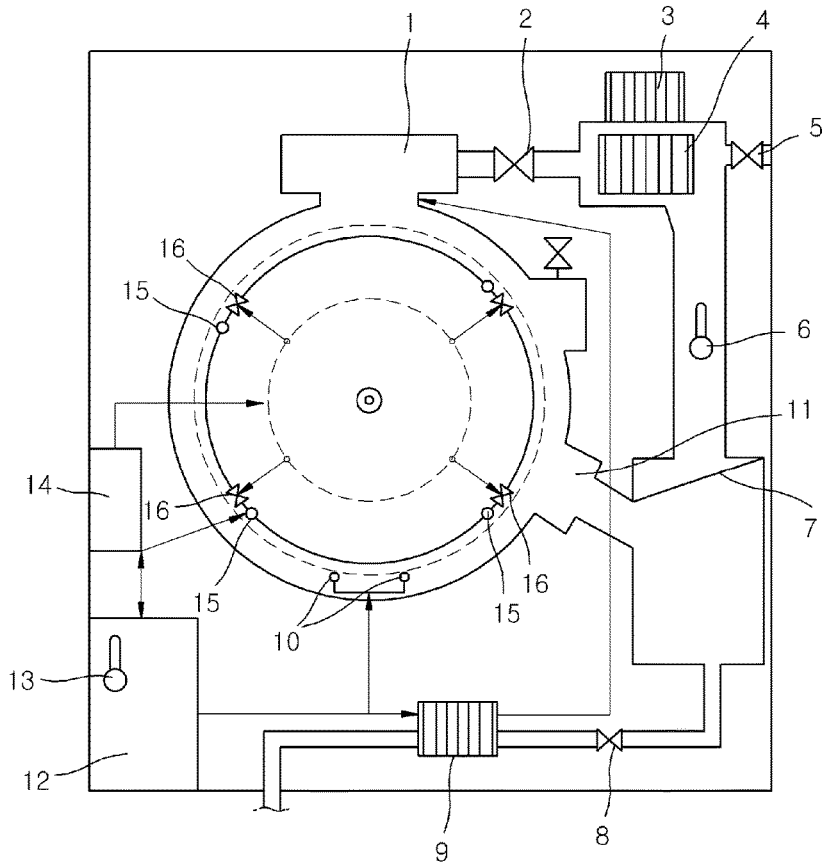

1: radiator
2: hot air/cold air circulation valve
3: fan motor
4: fan
5: air discharge/humidity control valve
6: temperature sensor
7: dust removing filter
8: drain valve
9: pump
10: air supplying nozzle (2 nozzles)
11: drum drain box
12: water tank
13: area of water to be supplied (water amount control sensor by electrical contact)
14: detergent supply box
15: mist supply nozzle (4 nozzles)
16: steam supply nozzle (4 nozzles)
17: valve for controlling pressure inside drum
18: second dust removing filter
19: drum cleaning nozzle

DRY CLEANING METHOD AND SYSTEM

CROSS-REFERENCE TO RELATED APPLICATION

This application claims priority to U.S. Application No. 61/763,315 filed on Feb. 11, 2013, which is incorporated herein by reference.

TECHNICAL FIELD

This invention relates to an apparatus (system) for cleaning dry-cleaning articles such as garments, bedroom and bathroom linen, curtains and the like and a method therefor.

BACKGROUND

Dry-cleaning apparatuses (systems) are known which comprise a rotary drum for containing articles, means for feeding and draining a solvent, and a closed circuit for circulating air for drying the articles contained in the drum and configured to allow air to flow through the drum. There is a need for new dry-cleaning apparatuses and methods that can clean articles more cost-effectively and/or safely and/or conveniently and/or environment-friendly.

SUMMARY

The present invention provides a dry cleaning method characterized in that water drainage is carried out in the state where a drum speed is set in the range of about 150 rpm to 300 rpm and temperature is set in the range of about 110° F. to 150° F.

According to an embodiment, the dry cleaning method is characterized in that hot mist water is supplied at the same time with the drainage or after or before the drainage.

According to another embodiment, the dry cleaning method is characterized in that air is supplied at the same time with the drainage or after or before the drainage.

According to the other embodiment, the dry cleaning method is characterized in that steam is supplied at the same time with the water supply or after or before the water supply in the state where the drum speed is set in the range of about 150 rpm to 300 rpm and temperature is set in the range of about 110° F. to 150° F.

BRIEF DESCRIPTION OF THE DRAWINGS

The above and other aspects and features of the present invention will become more apparent by describing in detail exemplary embodiments thereof with reference to the attached drawings, in which:

FIGS. 1A and 1B illustrate the front side and back side of a dry cleaning apparatus (system) according to a first embodiment of the present invention, respectively.

FIGS. 2A and 2B illustrate the front side and back side of a dry cleaning apparatus (system) according to a second embodiment of the present invention, respectively.

DETAILED DESCRIPTION OF THE INVENTION

Figure 1A:
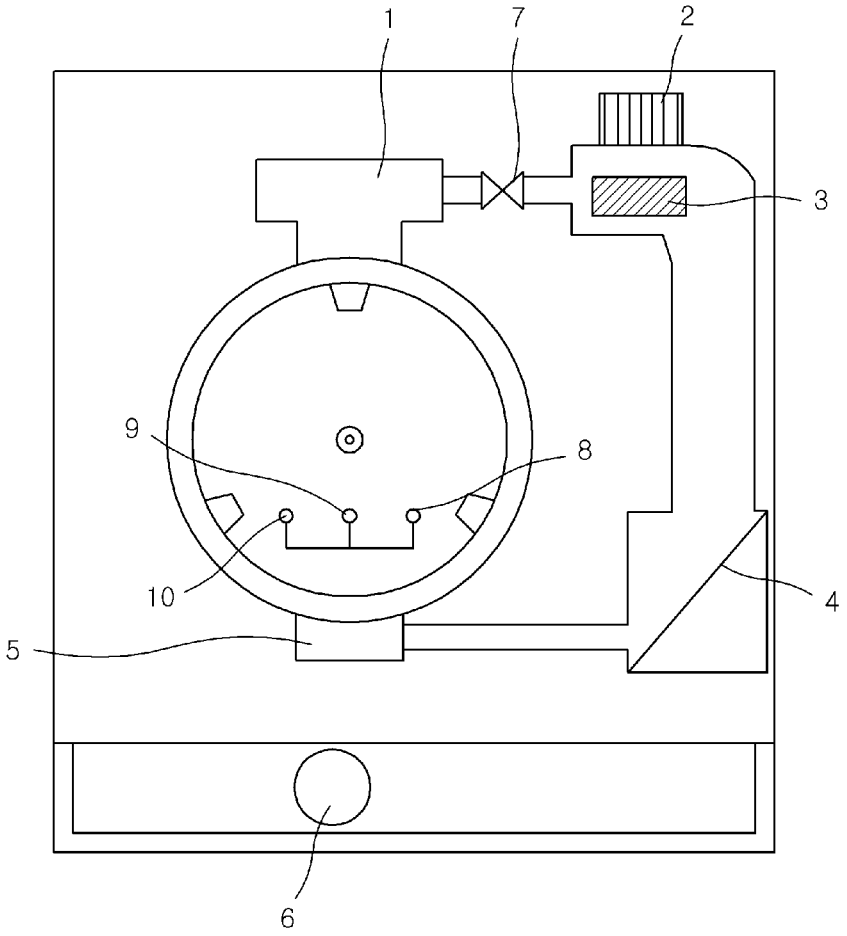

Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Throughout the specification, like reference numerals in the drawings denote like elements. In some exemplary embodiments, well-known steps, structures and techniques will not be described in detail to avoid obscuring the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, exemplary embodiments of the invention should not be construed as limited to the particular shapes of regions illustrated herein but are to include deviations in shapes that result, for example, from manufacturing. In the drawings, respective components may be enlarged or reduced in size for convenience of explanation.

Hereinafter, a dry cleaning system and a method for dry cleaning articles in accordance with exemplary embodiments of the present invention will be described with reference to the accompanying drawings.

First Embodiment

FIGS. 1A and 1B illustrate the front side and the back side of a dry cleaning system according to the first embodiment of the present invention. A dry cleaning method using the dry cleaning system according to the first embodiment of the present invention is described in the below.

A. Washing

In the state where a drum speed is set in the range of about 150 rpm to 300 rpm and temperature is set in the range of about 110° F. to 150° F. (for instance, using a steam radiator (1)), water is drained when a drain valve (8) is opened and a drain pump (9) is operated. At the same time with the drainage or after or before the drainage, hot mist water is supplied through an air valve (18) and a water supply valve (12) for about 1 minute to 10 minutes.

In the state where a drum speed is set in the range of about 150 rpm to 300 rpm and temperature is set in the range of 110° F. to 150° F. (for instance, using the steam radiator (1)), steam is supplied through a steam valve (11) for about 1 seconds to 20 seconds via a soap supply box (17) after or before the water supply or at the same time with the water supply through the water supply valve (12).

In the state where a drum speed is set in the range of about 150 rpm to 300 rpm and temperature is set in the range of about 110° F. to 150° F. (for instance, using the steam radiator (1)), water is drained when the drain valve (8) is opened and the drain pump (9) is operated. At the same time with the drainage or before or after the drainage, hot mist water is supplied through the air supply valve (18) and the water supply valve (12) for about 1 minute to 10 minutes.

B. Dehydration

In the state where a drum speed is set in the range of about 250 rpm to 450 rpm and temperature is set in the range of about 110° F. to 150° F. (for instance, using the steam radiator (1)), water is drained when the drain valve (8) is opened and the drain pump (9) is operated. At the same time with the drainage or before or after the drainage, air is supplied through the air supply valve (18) for about 1 minutes to 5 minutes.

C. Sterilization and Washing

In the state where a drum speed is set in the range of about 150 rpm to 300 rpm and temperature is set in the range of about 110° F. to 150° F. (for instance, using the steam radiator (1)), water is drained when the drain valve (8) is opened and the drain pump (9) is operated. At the same time with the drainage or before or after the drainage, water is supplied through the water supply valve (12), and at the same time with the water supply or before or after the water supply, hot mist water is supplied for about 1 minute to 10 minutes through the air valve (18) and the steam supply valve (11) so as to sterilize and wash dry-cleaning articles.

D. Dehydration

In the state where a drum speed is set in the range of about 150 rpm to 450 rpm and temperature is set in the range of about 110° F. to 150° F. (for instance, using the steam radiator (1)), water is drained when the drain valve (8) is opened and the drain pump (9) is operated.

Air is supplied through air supply valve (18) for about 1 minute to 5 minutes at the same time with the drainage or before or after the drainage.

E. Drying

In the state where a drum speed is set in the range of about 200 rpm to 450 rpm and temperature is set in the range of about 130° F. to 170° F. (for instance, using the steam radiator (1)), water is drained when the drain valve (8) is opened and the drain pump (9) is operated. At the same time with the drainage or before or after the drainage, an air discharge/humidity control valve (5) is opened and a fan motor(3) is operated to rotate a fan (4), thereby discharging air inside the drum and reducing humidity. Drying is carried out for about 15 minutes to 30 minutes while air is supplied.

F. Material optimization

In the state where a drum speed is set in the range of about 200 rpm to 400 rpm and temperature is set in the range of about 110° F. to 150° F. (for instance, using the steam radiator (1)), steam and air are supplied for about 1 second to 20 seconds through the steam supply valve (11) and the air supply valve (18).

In the state where a drum speed is set in the range of about 200 rpm to 400 rpm and temperature is set in the range of about 110° F. to 150° F. (for instance, using the steam radiator (1)), the air discharge/humidity control valve (5) is opened and the fan motor (3) is operated to rotate the fan (4), thereby discharging air inside the drum and controlling humidity for about 1 second to 50 seconds.

In the state where a drum speed is set in the range of about 200 rpm to 400 rpm and temperature is set in the range of about 110° F. to 150° F. (for instance, using the steam radiator (1)), steam and air are supplied for about 1 second to 20 seconds through the steam supply valve (11) and the air supply valve (18).

In the state where a drum speed is set in the range of about 200 rpm to 400 rpm and temperature is set in the range of about 110° F. to 150° F. (for instance, using the steam radiator (1)), the air discharge/humidity control valve (5) is opened and the fan motor (3) is operated to rotate the fan (4), thereby discharging air inside the drum and controlling humidity for about 1 second to 50 seconds.

In the state where a drum speed is set in the range of about 200 rpm to 400 rpm and temperature is set in the range of about 110° F. to 150° F. (for instance, using the steam radiator (1)), steam and air are supplied for about 1 second to 20 seconds through the steam supply valve (11) and the air supply valve (18).

In the state where a drum speed is set in the range of about 200 rpm to 400 rpm and temperature is set in the range of about 110° F. to 150° F. (for instance, using the steam radiator (1)), the air discharge/humidity control valve (5) is opened and the fan motor (3) is operated to rotate the fan (4), thereby discharging the air inside the drum and controlling humidity for about 1 second to 50 seconds.

G. Cooling down

In the state where a drum speed is set in the range of about 150 rpm to 300 rpm, a drum temperature control valve (15) and a hot air/cold air circulation valve (2) are opened and the fan motor (3) is operated to rotate the fan (4). The air discharge/humidity control valve (5) is opened, thereby circulating cold air and discharging hot air for about 1 minute to 5 minutes.

Second Embodiment

Figure 2A:
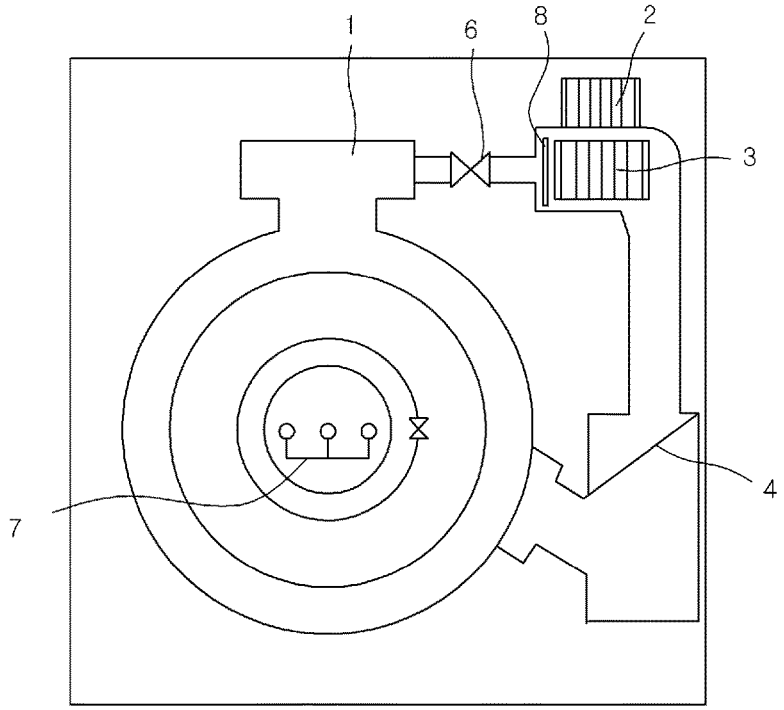

FIGS. 2A and 2B illustrate the front side and the back side of a dry cleaning system according to the second embodiment of the present invention. A dry cleaning method using the dry cleaning system according to the second embodiment of the present invention is described in the below.

A. Washing

In the state where a drum speed is set in the range of about 150 rpm to 300 rpm and temperature is set in the range of about 110° F. to 150° F. (for instance, using a steam radiator (1)), water is drained when a drain valve (8) is opened and a drain pump (9) is operated. At the same time with the drainage or after or before the drainage, hot mist water is supplied through an air valve (10) and a water supply valve (15) for about 1 minute to 10 minutes.

In the state where a drum speed is set in the range of about 150 rpm to 300 rpm and temperature is set in the range of 110° F. to 150° F. (for instance, using the steam radiator (1)), steam is supplied through a steam valve (11) for about 1 second to 20 seconds via a soap supply box (14) after or before the water supply or at the same time with the water supply through the water supply valve (12).

In the state where a drum speed is set in the range of about 150 rpm to 300 rpm and temperature is set in the range of about 110° F. to 150° F. (for instance, using the steam radiator (1)), water is drained when the drain valve (8) is opened and the drain pump (9) is operated. At the same time with the drainage or before or after the drainage, hot mist water is supplied through the air supply valve (10) and the water supply valve (15) for about 1 minute to 10 minutes.

B. Dehydration

In the state where a drum speed is set in the range of about 250 rpm to 450 rpm and temperature is set in the range of about 110° F. to 150° F. (for instance, using the steam radiator (1)), water is drained when the drain valve (8) is opened and the drain pump (9) is operated. At the same time with the drainage or before or after the drainage, air is supplied through the air supply valve (10) for about 1 minute to 5 minutes.

C. Sterilization and Washing

In the state where a drum speed is set in the range of about 150 rpm to 300 rpm and temperature is set in the range of about 110° F. to 150° F. (for instance, using the steam radiator (1)), water is drained when the drain valve (8) is opened and the drain pump (9) is operated. At the same time with the drainage or before or after the drainage, water is supplied through the water supply valve (12), and at the same time with the water supply or before or after the water supply, hot mist water is supplied for about 1 minute to 10 minutes through the air valve (10) and the steam supply valve (16) so as to sterilize and wash.

D. Dehydration

In the state where a drum speed is set in the range of about 150 rpm to 450 rpm and temperature is set in the range of about 110 rpm to 150° F. (for instance, using the steam radiator (1)), water is drained when the drain valve (8) is opened and the drain pump (9) is operated. Air is supplied through air supply valve (10) for about 1 minute to 5 minutes at the same time with the drainage or before or after the drainage.

E. Drying

In the state where a drum speed is set in the range of about 200 rpm to 450 rpm and temperature is set in the range of about 130° F. to 170° F. (for instance, using the steam radiator (1)), water is drained when the drain valve (8) is opened and the drain pump (9) is operated. At the same time with the drainage or before or after the drainage, an air discharge/humidity control valve (5) is opened and a fan motor (3) is operated to rotate a fan (4), thereby discharging air inside the drum and reducing humidity. Drying is carried out for about 15 minutes to 30 minutes while air is supplied.

F. Material optimization

In the state where a drum speed is set in the range of about 200 rpm to 400 rpm and temperature is set in the range of about 110° F. to 150° F. (for instance, using the steam radiator (1)), steam and air are supplied for about 1 second to 20 seconds through the steam supply valve (16) and the air supply valve (10).

In the state where a drum speed is set in the range of about 200 rpm to 400 rpm and temperature is set in the range of about 110° F. to 150° F. (for instance, using the steam radiator (1)), the air discharge/humidity control valve (5) is opened and the fan motor (3) is operated to rotate the fan (4), thereby discharging air inside the drum and controlling humidity for about 1 second to 50 seconds.

In the state where a drum speed is set in the range of about 200 rpm to 400 rpm and temperature is set in the range of about 110° F. to 150° F. (for instance, using the steam radiator (1)), steam and air are supplied for about 1 second to 20 seconds through the steam supply valve (16) and the air supply valve (10).

In the state where a drum speed is set in the range of about 200 rpm to 400 rpm and temperature is set in the range of about 110° F. to 150° F. (for instance, using the steam radiator (1)), the air discharge/humidity control valve (5) is opened and the fan motor (3) is operated to rotate the fan (4), thereby discharging air inside the drum and controlling humidity for about 1 second to 50 seconds.

In the state where a drum speed is set in the range of about 200 rpm to 400 rpm and temperature is set in the range of about 110° F. to 150° F. (for instance, using the steam radiator (1)), steam and air are supplied for about 1 second to 20 seconds through the steam supply valve (16) and the air supply valve (10).

In the state where a drum speed is set in the range of about 200 rpm to 400 rpm and temperature is set in the range of about 110° F. to 150° F. (for instance, using the steam radiator (1)), the air discharge/humidity control valve (5) is opened and the fan motor (3) is operated to rotate the fan (4), thereby discharging the air inside the drum and controlling humidity for about 1 second to 50 seconds.

G. Cooling down

In the state where a drum speed is set in the range of about 150 rpm to 300 rpm, a drum temperature control valve (17) and a hot air/cold air circulation valve (2) are opened and the fan motor (3) is operated to rotate the fan (4). The air discharge/humidity control valve (5) is opened, thereby circulating cold air and discharging hot air for about 1 minute to 5 minutes.

The effects of the present invention are not limited thereto, and other effects of the present invention can be apparently understood from the description of claims.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A dry cleaning method comprising:

draining water a first time from a rotating drum, wherein a drum rotation speed of the drum is set in a range of about 150 rpm to 300 rpm and a temperature in the drum is set in a range of about 110° F. to 150° F. while simultaneously supplying combined flows of an air flow through an air valve and a water flow through a water valve into the rotating drum;

subsequently supplying steam from an isolated steam supply, through an isolated soap supply box that is separate and distinct from the steam supply and the rotating drum, then through a steam valve, and into the rotating drum, the steam encountering soap for a first time while traversing the isolated soap supply box, the steam and soap traversing the isolated soap supply box and the steam valve in a single direction to the rotating drum, the steam being incapable of returning to the soap supply box after initially traversing the isolated soap supply box; and subsequently draining water a second time from the rotating drum while simultaneously supplying combined flows of the air flow from the air valve and the water flow from the water valve into the rotating drum.

2. The dry cleaning method according to claim 1, further comprising supplying air from the air valve after draining the water the second time.

3. A dry cleaning method comprising:

setting a speed of a rotating drum to a range of about 150 rpm to 300 rpm and a temperature of the rotating drum to a range of about 110 degrees F. to 150 degrees F.;

subsequently opening a first steam valve to supply steam to the rotating drum while simultaneously opening a first water supply valve to supply water to the rotating drum for between 1 and 20 seconds, the steam supplied thereto originating from an isolated steam supply, traveling through an isolated soap supply box that is separate and distinct from the steam supply and the rotating drum, and into the first steam valve, the steam encountering soap for a first time while traversing the isolated soap supply box, the steam and soap traversing the isolated soap supply box and the steam valve in a single direction to the rotating drum, the steam being incapable of returning to the soap supply box after initially traversing the isolated soap supply box; and subsequently opening a drain valve and actuating a drain pump to drain water from the rotating drum while simultaneously opening and combining flow into the rotating drum from a first air valve and the first water valve for between 1 and 10 minutes, wherein the first steam valve, the first water supply valve, and the first air valve are distinct and separate valves from one another.

4. The dry cleaning method according to claim 1, further comprising:

supplying air from the air valve into the rotating drum before draining the water the first time.

5. The dry cleaning method according to claim 1, wherein the water flow through the water valve is not mixed with any other liquid.

6. The dry cleaning method according to claim 3, further comprising:

after draining water, setting the speed of the rotating drum to a range of about 250 rpm to 450 rpm and maintaining the temperature of the rotating drum in the range of about 110 degrees F. to 150 degrees F.; and subsequently closing the first water supply valve while supplying air to the rotating drum from the air supply valve for between 1 and 5 minutes.

* * * * *